US005928114A

United States Patent [19]

Chen

[11] Patent Number: 5,928,114

[45] Date of Patent: Jul. 27, 1999

[54] EXERCISE BICYCLE AND ADJUNCT DEVICE THEREOF

[76] Inventor: Robert W.P. Chen, No. 5, Hwang Pou Village, Fuhsing Hsiang, Chang Hua Hsien, Taiwan

[21] Appl. No.: 09/003,600

[22] Filed: Jan. 7, 1998

[51] Int. Cl.[6] ..... A63B 69/16; A63B 22/04

[52] U.S. Cl. ..... 482/57; 482/51; 482/70

[58] Field of Search ..... 482/51, 52, 53, 482/57, 70, 79, 80, 71, 74, 62, 662, 663

[56] References Cited

U.S. PATENT DOCUMENTS

| | | | |
|---|---|---|---|
| 4,768,777 | 9/1988 | Yang | 482/57 |
| 5,299,992 | 4/1994 | Wilkinson | 482/52 |
| 5,685,804 | 11/1997 | Whah-Tona et al. | 482/51 |
| 5,807,211 | 9/1998 | Berryhill | 482/57 |
| 5,823,917 | 10/1998 | Chen | 482/57 |
| 5,836,854 | 11/1998 | Kuo | 482/57 |
| 5,860,895 | 1/1999 | Lee | 482/51 |

*Primary Examiner*—Stephen R. Crow
*Attorney, Agent, or Firm*—Browdy and Neimark

[57] ABSTRACT

An exercise bicycle is composed of a base frame and an adjunct device. The base frame is formed of a first support tube, a second support tube, and a seat. The first support tube is provided with a shaft tube on which a crank is mounted. The crank is provided with two support shafts separated from each other for fastening pedals. The second support tube is located between two ends of the base frame and is provided at the top end thereof with a handlebar. The adjunct device consists of two long tread rods of a metal material and provided with two foot pads. The long tread rods are fastened pivotally and respectively at one end thereof with the crank such that another ends of said long tread rods are supported by two support elements at a level for doing a reciprocating motion. An exerciser is seated on the seat such that both feet of the exerciser pedal, or that the exerciser stands on the foot pads for doing a revolving treading motion.

17 Claims, 4 Drawing Sheets

EXERCISE BICYCLE AND ADJUNCT DEVICE THEREOF

FIELD OF THE INVENTION

The present invention relates generally to an exercise device, and more particularly to an indoor exercise bicycle and adjunct device.

BACKGROUND OF THE INVENTION

The indoor exercise bicycle is generally provided with a crank set located under or in front of the seat. The exerciser pedal the bicycle to drive a wheel loaded with a weight. The improved indoor exercise bicycle is generally composed of a loaded wheel having an electromagnet for bringing about an adjustable attraction load.

Such prior art exercise bicycles as described above have one thing in common in that they have only one function or purpose. In addition, none of the prior art exercise bicycles is equipped with the adjunct device.

SUMMARY OF THE INVENTION

It is the primary objective of the present invention to provide an exercise bicycle capable of being used as an ordinary bicycle or a trampling machine.

It is another objective of the present invention to provide an exercise bicycle capable of being used by two persons at the same time such that one of the two persons rides the bicycle and that another one of the two persons does the trampling.

It is still another objective of the present invention to provide an exercise bicycle with its adjunct device capable of being detachably fastened with the bicycle.

In keeping with the principle of the present invention, the foregoing objective of the present invention is attained by the exercise bicycle consisting of a base frame provided with a seat mounted thereon and a crank set located under or in front of the seat. The crank is provided at both ends thereof with two pedals. A handlebar set is mounted in front of the seat for balancing the body of a person seated on the seat. An adjunct device is mounted on the base frame such that the adjunct device is opposite in location to the seat. The adjunct device comprises a support tube which is provided at the top end thereof with two swing arms. The adjunct device further comprises two long tread rods which are fastened pivotally at one end thereof with the swing arm and at another end thereof with the two cranks or a member driven by the crank. The two long tread rods are detachably mounted on the cranks such that the two long tread rods are capable of swiveling on the cranks, and that another ends of the two long tread rods are capable of moving back and forth.

The foregoing objectives, features and functions of the present invention will be more readily understood upon a thoughtful deliberation of the following detailed description of the embodiments of the present invention with reference to the accompanying drawings.

DETAILED DESCRIPTION OF THE INVENTION

Figure 1:
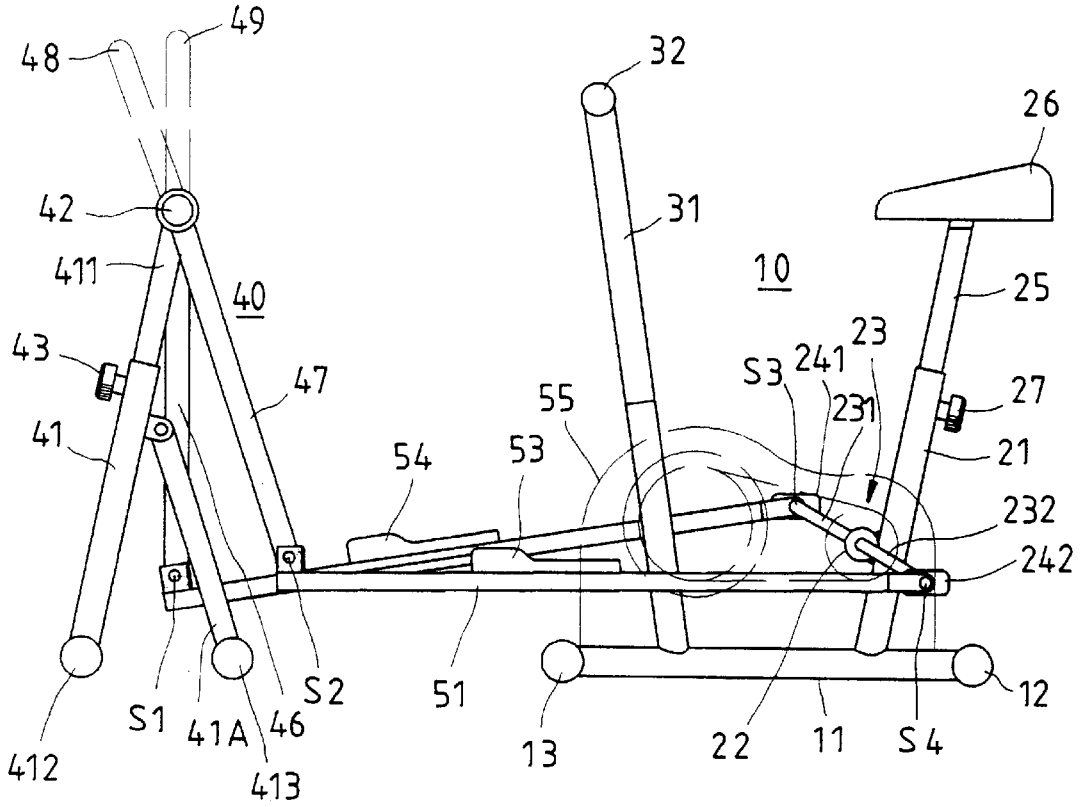
FIG. 1 shows a front view of a first preferred embodiment of the present invention.
Figure 2:
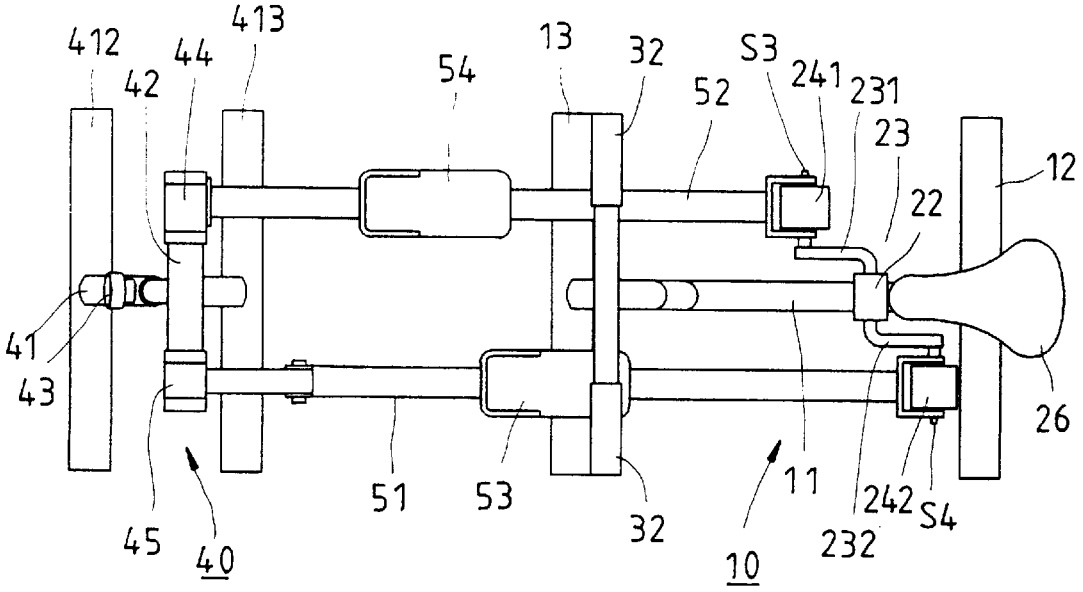
FIG. 2 show a top view of the first preferred embodiment of the present invention.

As shown in FIGS. 1 and 2, an exercise bicycle 10 of the first preferred embodiment of the present invention is basically similar in construction to the conventional exercise bicycles and is composed of a base frame formed of metal tubes by welding. The base frame is located on the floor and is composed of a bottom tube 11 located at the center of the base frame and provided at both ends thereof with bottom cross tubes 12 and 13. A first support tube 21 is securely mounted on the base frame 10 and is provided in one side thereof with a shaft tube 22 which is fastened pivotally with a crank 23. The crank 23 has two support arms 231 and 232 which are separated by an angle of 180 degrees and are provided respectively at the outer end thereof with a shaft pin $S_3$ or $S_4$, and a pedal 241 or 242 fastened pivotally therewith. The top end of the support tube 21 is fitted into a seat rod 25 which is provided at the top end thereof with a seat 26. The seat 26 is located at a level which can be adjusted by extracting or retracting the seat rod 25 in conjunction with a fastening bolt 27 for locating the seat 26 at a desired level. A second support tube 31 is mounted on the base frame 10 and in front of the seat 26 and is provided at the top thereof with a handlebar 32 for balancing a person seated on the seat 26. The handlebar 32 is provided with an electronic gauge (not shown in the drawings) for displaying the data relating to the exercises.

An adjunct device 40 is assembled to the exercise bicycle 10 and is composed of a third support tube 41 and a support rod 41A which is located outside the bicycle 10 and is provided at the bottom thereof with two bottom tubes 412 and 413 in contact with the floor and having a top end which is fitted into an inner rod 411 having at the top end thereof a cross rod 42. A Locking bolt 43 is located at the side of the support tube 41 for adjusting and locating the support tube 41 at a level inside the inner tube 411. Two shaft sleeves 44 and 45 fastened pivotally on the cross rod 42 is capable of turning smoothly and are provided respectively at the bottom thereof with a swing arm 46 and 47. If necessary, the swing arms 46 and 47 may be provided at the top thereof with grip rods 48 and 49. Two long tread rods 51 and 52 of a metal material are fastened pivotally at one end thereof with the bottom ends of the swing arms 46 and 47 by means of two shaft pins $S_1$ and $S_2$, and at another end thereof with the shaft pins $S_3$ and $S_4$ of the crank 23, thereby enabling both ends of the long tread rods 51 and 52 to be supported such that both ends thereof can be swiveled and moved up and down in a reciprocating manner. The long tread rods 51 and 52 may be provided with two tread pads 53 and 54 for treading by the exerciser.

Figure 3:
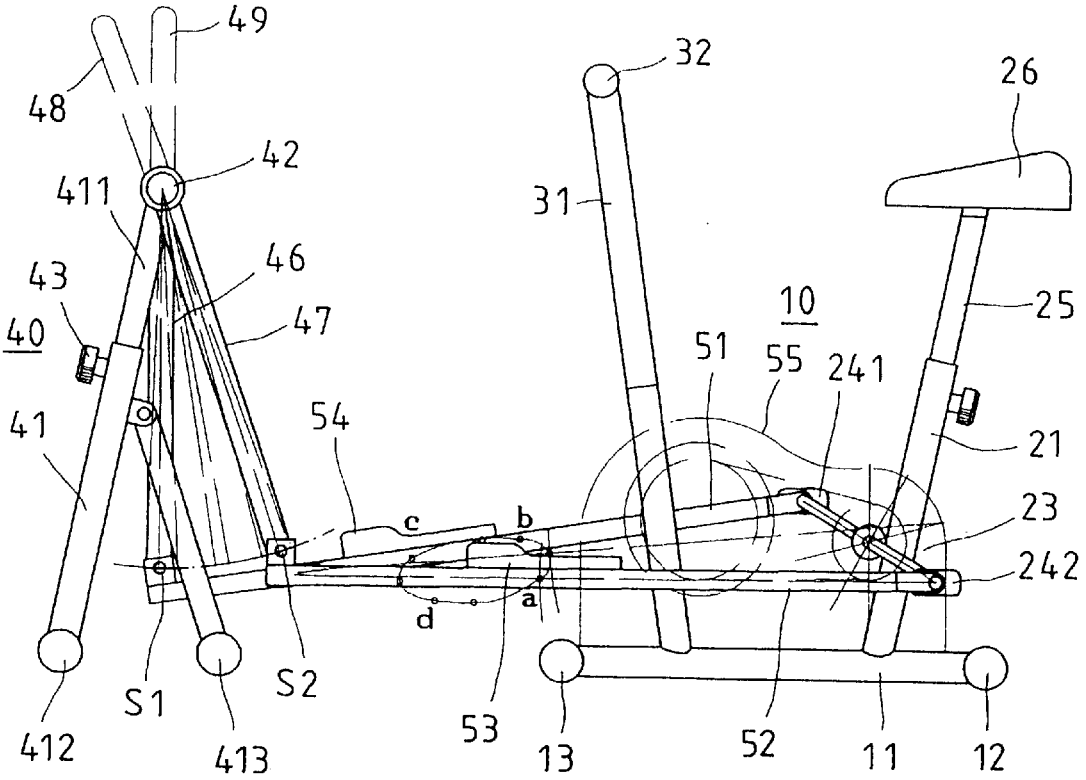
FIG. 3 shows a schematic view of the first preferred embodiment of the present invention at work.

As shown in FIG. 3, an exerciser is seated on the seat 26 such that both hands of the exerciser hold the handlebars 32, and that both feet of the exerciser pedal the pedals 241 and 242 to drive the crank 23. The exerciser may stand on the tread pads 53 and 54 such that both hands of the exerciser hold the handlebars 32 or the grip rods 48 and 49, and that both feet tread the tread pads 53 and 54 to actuate one end of each of the long tread rods 51 and 52 to swivel along with the crank 23 in motion. Both feet of the exerciser are supposed to move in an oval path "a-b-c-d" to imitate the mountain-climbing. The bicycle of the present invention may be used by two persons at the same time such that one of the two persons rides the exercise bicycle 10, and that another one does the treading exercise by stepping on the tread pads 53 and 54 of the long tread rods 51 and 52.

The upper expandable rod 411 of the third support tube 41 can be extracted or retracted before being located by the locking bolt 43 for changing the level at which the cross rod 42 is located. In other words, a change in the magnitude of the exercise output of the person doing the treading exercise can be attained by adjusting the level at which the ends of the long tread rods 51 and 52 are located.

The long tread rods 51 and 52 of the adjunct device 40 of the present invention are detachably fastened with the crank 23 as independent unit members. Other adjustable load may be added to the periphery of the long tread rods 51 and 52. The adjustable load may be a spring or cylinder. The exercise bicycle 10 of the present invention may be decorated with a casing 55, which serves as an ornament as well as a protective cover. In addition, the bicycle 10 of the present invention may be provided with a gauge for giving an added commercial value to the bicycle 10.

Figure 4:
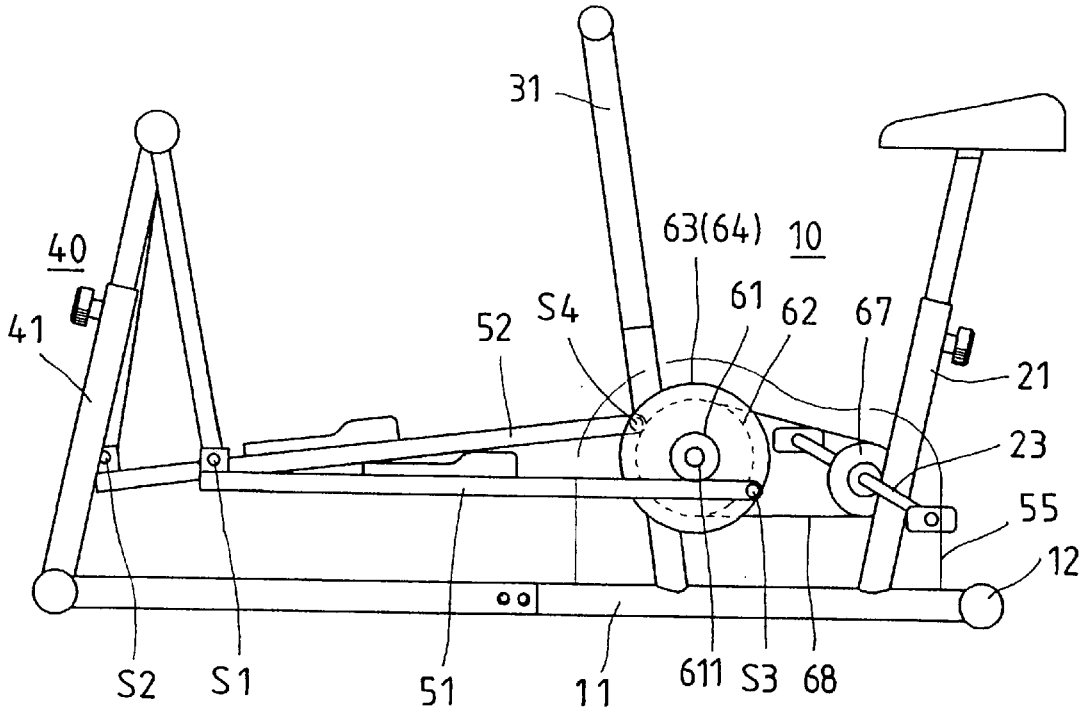
FIG. 4 shows a front view of a second preferred embodiment of the present invention.
Figure 5:
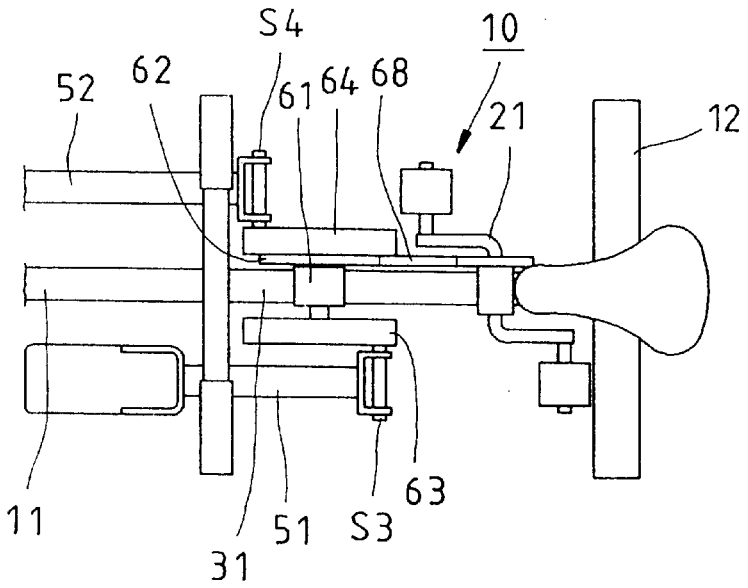
FIG. 5 shows a partial top view of the second preferred embodiment of the present invention.

As shown in FIGS. 4 and 5, a bicycle 10 of the second preferred embodiment of the present invention is composed of the basic structural components, such as the bottom tube 11, the first, the second and the third support tubes 21, 31 and 41, and two long tread rods 51 and 52. The second support tube 31 is provided with a shaft tube 61 having a center with which a shaft rod 611 is fastened pivotally. The shaft rod 611 is provided with a chain wheel or belted wheel 62, and two weighted wheels 63 and 64. The weighted wheels 63 and 64 are provided respectively in the outer side thereof with shaft pin $S_3$ and $S_4$ separated by an angle of 180 degrees. The shaft pins S3 and S4 are fastened pivotally with the long tread rods 51 and 52 for effecting an action similar to that of the crank of the first preferred embodiment of the present invention for driving the long tread rods 51 and 52 to move up and down. The crank 23 is provided with a chain wheel or belted wheel 67 with a chain or belt 68 for linking the chain wheel 62. When the crank 23 is rotated to actuate the shaft rod 611, the weighted wheels 63 and 64, the weighted wheels 63 and 64 link with the long tread rods 51 and 52 via the shaft pins $S_3$ and S4 such that the long tread rods 51 and 52 make an oval swiveling motion. On the other hand, when the long tread rods 51 and 52 are in the oval swiveling motion, the weighted wheels 63 and 64 are driven to turn. As a result, two persons are allowed to use the bicycle at the same time. The weighted wheels 63 and 64 are intended to provide an appropriate load and the motion inertia and are therefore subject to a change in structure or shape.

Figure 6:
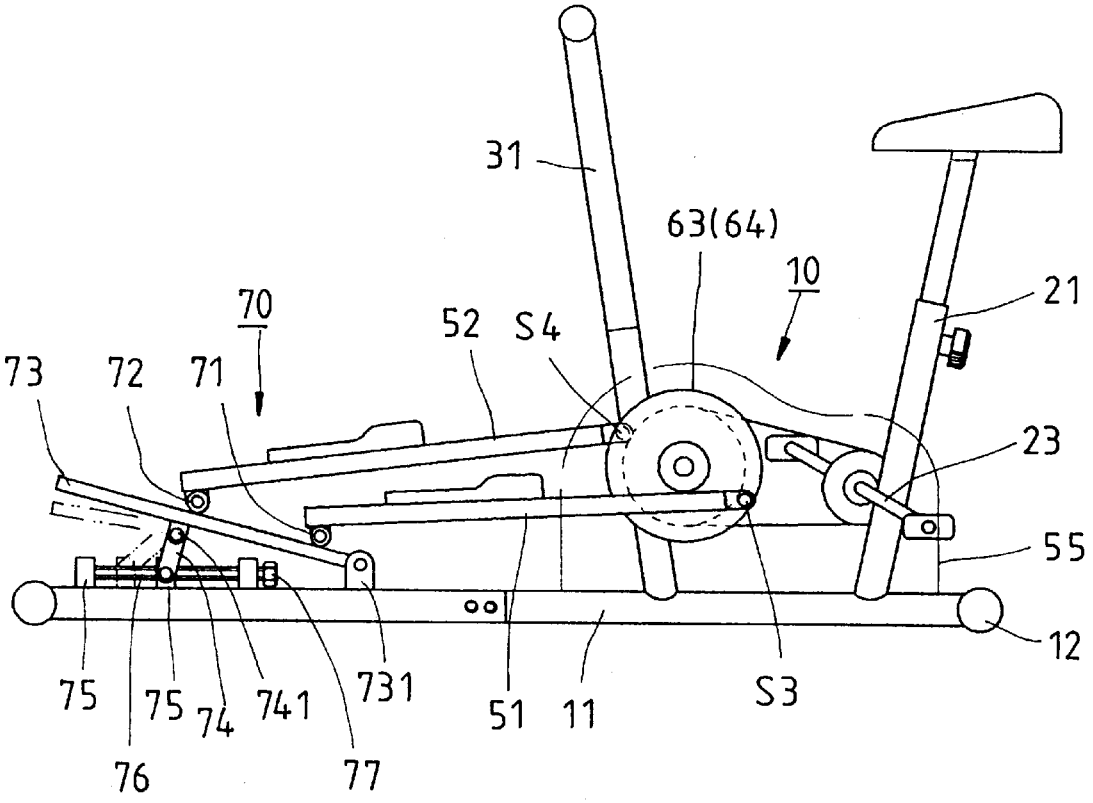
FIG. 6 shows a front view of a third preferred embodiment of the present invention.

As shown in FIG. 6, a bicycle 10 of the third preferred embodiment of the present invention is similar in construction to those of the preceding embodiments described above. The adjunct device 70 comprises two long tread rods 51 and 52, which are fastened pivotally at one end thereof with the shaft pins $S_3$, $S_4$ of the weighted wheels 63, 64. However, the long tread rods 51 and 52 are provided at another end thereof with two rollers 71, 72. A guide member 73 is fastened pivotally at one end thereof with a pivoting member 731 of the bottom tube 11, and at another end thereof with the top end of a support element 74 by means of a pivoting member 741. The support element 74 is fastened pivotally at the bottom end thereof with a sliding member 75 having inner threads and capable of being moved by a rotary button 77 along with a threaded rod 76 so as to bring about a change in the angular position of the support element 74 as well as a change in the inclination of the guide member 73. As a result, the load of the treading exercise can be changed by changing the level at which the rollers 71 and 72 of the long tread rods 51 and 52 move on the guide member 73.

Figure 7:
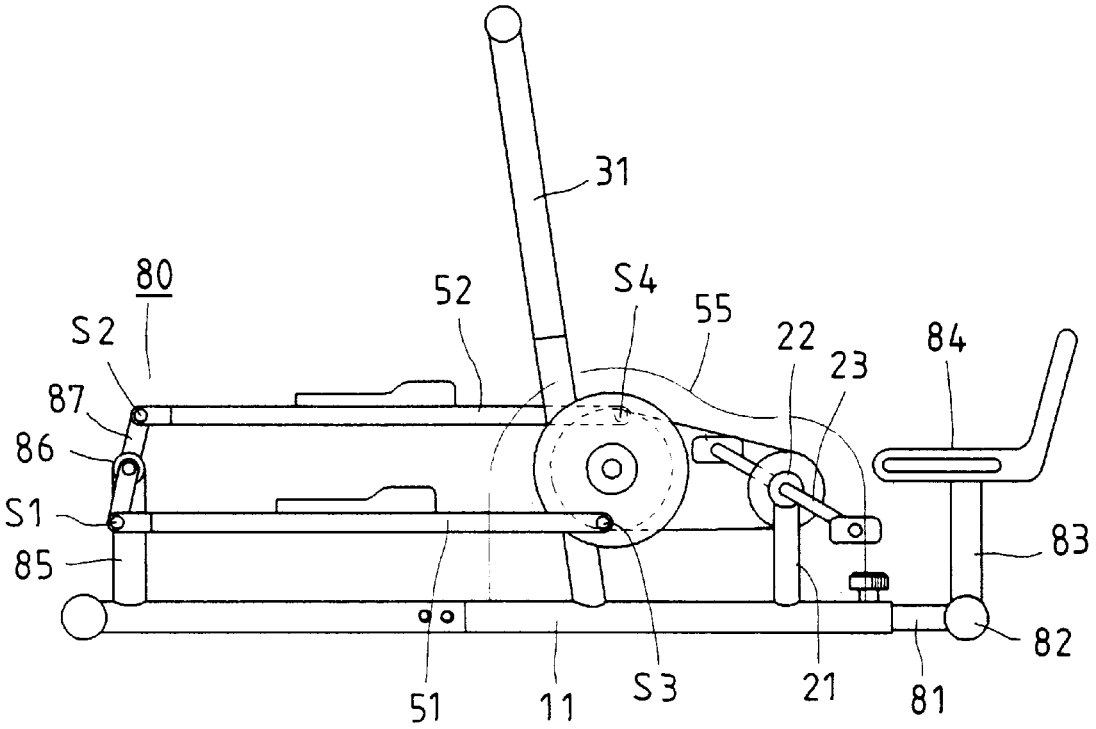
FIG. 7 shows a front view of a fourth preferred embodiment of the present invention.

As shown in FIG. 7, an exercise bicycle of the fourth preferred embodiment of the present invention is basically similar in construction to those of the preceding embodiments described above, with the only difference being that the first support tube 21 of the bottom tube 11 of the former is provided with a shaft tube 22 and a crank 23. The bottom tube 11 is further provided at the rear end thereof with an inner tube 81 which is welded at one end thereof with a cross tube 82 and is vertically provided with a second support tube 83 which is in turn provided with a chair 84. In addition, the adjunct device 80 comprises a third support tube 85 and provided at the top end thereof with a shaft tube 86 and a crank 87 fastened pivotally therewith. The long tread rods 51 and 52 are fastened pivotally at one end thereof with the shaft pins $S_3$, $S_4$, and at another end thereof with the shaft pins $S_1$, $S_2$ of both ends of the crank 87. As a result, the long tread rods 51 and 52 can be trodden to swivel up and down in a parallel manner.

Figure 8:
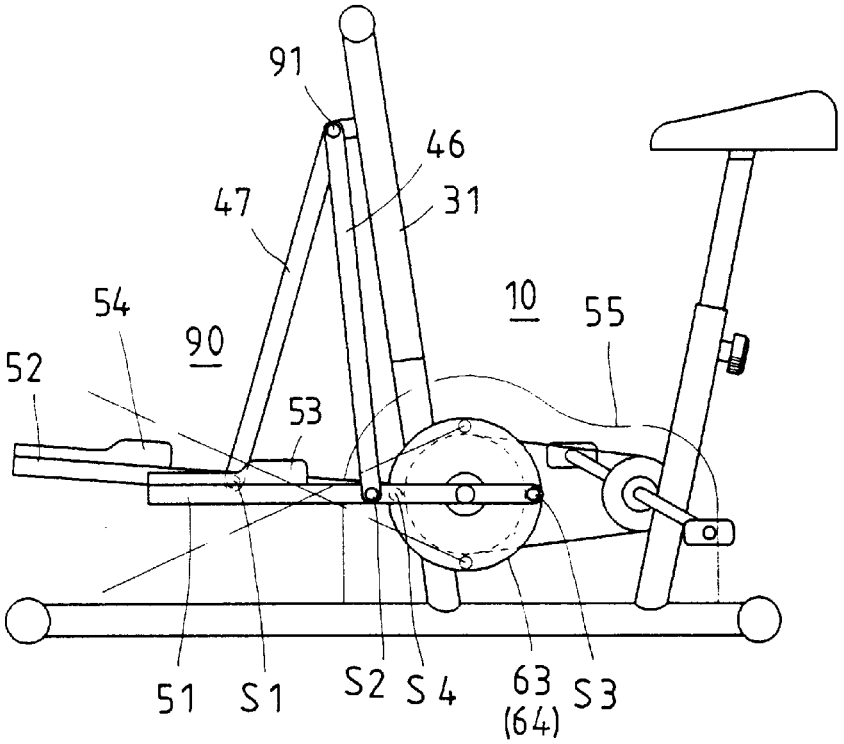
FIG. 8 shows a front view of a fifth preferred embodiment of the present invention.

As shown in FIG. 8, an exercise bicycle 10 of the fifth preferred embodiment of the present invention is basically similar in construction to those of the preceding embodiments described above, with the only difference being that the former has an adjunct device 90, which consists of two swing arms 46 and 47, which are fastened pivotally at one end thereof with a shaft rod 91 such that the swing arms 46 and 47 are capable of swinging back and forth. The swing arms 46 and 47 are fastened pivotally at the bottom end thereof with two long tread rods 51 and 52 by means of the shaft pins $S_1$, $S_2$, and at another end thereof with the shaft pins $S_3$, $S_4$ of the weighted wheels 63, 64. The long tread rods 51 and 52 are provided with tread pad 53, 54 to facilitate the treading of feet of an exerciser. The tread pad 53 or 54 is capable of an oval swiveling motion.

The adjunct devices 70, 80 and 90 described above are in fact integral parts of the bicycles of the present invention. In practice, the adjunct devices 70, 80 and 90 can be separated from the bicycle 10 as independent satellite units in a way that is illustrated in the first preferred embodiment of the present invention. The adjunct devices 70, 80 and 90 are compatible with the conventional exercise bicycles. In other words, the adjunct devices 70, 80 and 90 of the present invention can be joined with a conventional exercise bicycle by fastening the two shaft pins of the two long tread rods 51 and 52 with the two cranks or weighted wheels of the conventional exercise bicycle.

Certain portions of the exercise bicycle of the present invention are provided with a casing (not shown in the drawings) for enhancing the esthetic effect of the bicycle. In addition, the support tubes are appropriately curved to enhance the commercial forms of the bicycle. The swing arms 46 and 47 may be formed of a metal tube or steel cable. Moreover, the power source of the bicycle crank may be a motor.

The embodiments of the present invention described above are deemed to be illustrative and not restrictive. Accordingly, the present invention may be embodied in other specific forms without deviating from the spirit thereof. The present invention is therefore to be limited only by the scopes of the following appended claims.

What is claimed is:

1. An exercise bicycle comprising a first support tube, a second support tube, and a seat, said first support tube provided with a shaft tube and said seat, said shaft tube provided with a crank and pedals, said second support tube being separated from said first support tube by an appropriate distance and provided at a top end thereof with a handlebar, said bicycle further comprising an adjunct device consisting of two long tread rods of a metal material and provided with foot pads, said long tread rods further provided respectively at one end thereof with said crank fastened pivotally such that said crank is capable of a revolving motion along with said long tread rods, said long tread rods each having another end supported and located at a level such that said another end is capable of a reciprocating motion, said seat intended for use by a person to be seated thereon for riding said bicycle, said foot pads of said two long tread rods intended for use by a person to stand thereon for doing a revolving treading motion.

2. The exercise bicycle as defined in claim 1, wherein said adjunct device comprises a third support tube capable of being erected side by side with said first support tube and said second support tube on a floor, said third support tube provided with a cross tube which is in turn provided respectively at both ends thereof with a shaft sleeve capable of turning and being fastened with a swing arm capable of swinging back and forth, said swing arm being fastened pivotally at a bottom end thereof with one end of one of said two long tread rods for suspending one of said two long tread rods and for enabling one of said two long tread rods to swivel.

3. The exercise bicycle as defined in claim 2, wherein said third support tube is provided at a top end thereof with an inner rod fitted thereinto such that said inner rod can be adjusted to locate at a level inside said third support tube.

4. The exercise bicycle as defined in claim 1, wherein said adjunct device comprises a guide member fastened pivotally at one end thereof with a bottom tube such that a bottom of another end of said guide member is obliquely supported by a support element at a level, said support element being fastened pivotally at a bottom end thereof with a sliding member capable of being rotated by a threaded rod to bring about a change in an inclined position at which said flat plate is supported by a top end of said support element; and wherein said two long tread rods are provided at one end thereof with two rollers in contact with a surface of said guide member.

5. The exercise bicycle as defined in claim 1, wherein said adjunct device comprises a third support tube capable of being erected on a floor, said third support tube provided at a top end thereof with a crank capable of turning, said crank further provided respectively in two sides thereof with a shaft pin for fastening pivotally one end of said two long tread rods, said two long tread rods being fastened pivotally at another end thereof with a crank or weighted wheel of the bicycle.

6. The exercise bicycle as defined in claim 1, wherein said adjunct device comprises a shaft rod located at a level on said second support tube and fastened pivotally with two swing arms capable of swinging freely, said two swing arms fastened pivotally and respectively at a bottom end thereof with middle of said two long tread rods such that said two long tread rods are suspended, and that said two long tread rods are fastened pivotally at one end thereof with a crank or weighted wheel of the bicycle, and further that said two long tread rods are provided respectively at another end thereof with a foot pad.

7. The exercise bicycle as defined in claim 6, wherein said shaft rod is adjustably located at a level on said second support tube.

8. The exercise bicycle as defined in claim 4, wherein said adjunct device is an independent device capable of being detachably fastened with two shaft pins of a crank of a conventional exercise bicycle.

9. An exercise bicycle comprising:

a first support tube provided with a shaft tube and a seat, said shaft tube provided with a crank and pedals, said crank capable of actuating two weighted wheels through a transmission chain, said two weighted wheels being separated from each other and provided respectively with a shaft pin;

a second support tube separated from said first support tube by an appropriate distance and provided at a top end thereof with a handlebar; and an adjunct device consisting of two long tread rods of a metal material and provided with two foot pads fastened therewith, said two long tread rods being fastened pivotally and respectively at one end thereof said shaft pin located at an outer side of said weighted wheel driven by said crank such that said two long tread rods are capable of revolving along with said pedals, said two long tread rods being supported on another end thereof such that said two long tread rods are capable of a reciprocating motion at a level.

10. The exercise bicycle as defined in claim 9, wherein said adjunct device comprises a third support tube capable of being erected side by side with said first support tube and said second support tube on a floor or ground, said third support tube provided with a cross rod provided respectively at one end thereof with a shaft sleeve, said adjunct device further comprising two swing arms fastened pivotally with said two shaft sleeves and fastened pivotally and respectively at a bottom end thereof with one end of said two long tread rods such that said two long tread rods are suspended, and that said two long tread rods are capable of swiveling.

11. The exercise bicycle as defined in claim 10, wherein said third support tube is provided at a top end thereof with an inner rod fitted thereinto such that said inner rod can be adjusted to locate at a level inside said third support tube.

12. The exercise bicycle as defined in claim 9, wherein said adjunct device consists of a guide member fastened pivotally at one end thereof with a bottom tube such that said guide member is supported at a bottom of another end thereof by a top end of a support element at a level, said support element having a bottom end capable of being actuated by a sliding member to alter an inclination at which said guide member is supported by said top end of said support element; and wherein said two long tread rods are provided respectively at one end thereof with a roller in contact with a surface of said guide member.

13. The exercise bicycle as defined in claim 9, wherein said adjunct device comprises a third support tube capable of being erected vertically on a floor, said third support tube provided at a top end thereof with a crank fastened pivotally therewith, said crank further provided respectively in two sides thereof with a shaft pin for fastening pivotally one end of one of said two long tread rods, with another end of said two long tread rods being fastened pivotally with a crank or weighted wheel of the exercise bicycle.

14. The exercise bicycle as defined in claim 9, wherein said adjunct device comprises a shaft rod located on said second support tube at a level and provided with two swing arms fastened pivotally therewith such that said two swing arms are fastened pivotally with middle of each of said two long tread rods, and that said two long tread rods are suspended by said two swing arms, said two long tread rods being fastened pivotally at one end thereof with said crank or weighted wheel of the exercise bicycle, said two long tread rods being provided respectively at another end thereof with a foot pad fastened therewith.

15. The exercise bicycle as defined in claim 14, wherein said shaft rod of said adjunct device is adjustably located at a level on said second support tube.

16. The exercise bicycle as defined in claim 5, wherein said adjunct device is an independent device capable of being detachably fastened with two shaft pins of a crank of a conventional exercise bicycle.

17. The exercise bicycle as defined in claim 6, wherein said adjunct device is an independent device capable of being detachably fastened with two shaft pins of a crank of a conventional exercise bicycle.

* * * * *